US012807386B2

(12) United States Patent
Sun et al.

(10) Patent No.: US 12,807,386 B2
(45) Date of Patent: Nov. 24, 2026

(54) CHILD-RESISTANT PACKAGING FOR BUTTON CELL BATTERIES

(71) Applicant: Zhuhai Zhi Li Battery Co., Ltd., Zhuhai (CN)

(72) Inventors: Fajiong Sun, Zhuhai (CN); Xunwen Wu, Zhuhai (CN)

(73) Assignee: Zhuhai Zhi Li Battery Co., Ltd., Zhuhai (CN)

( * ) Notice: Subject to any disclaimer, the term of this patent is extended or adjusted under 35 U.S.C. 154(b) by 0 days.

(21) Appl. No.: 18/892,898

(22) Filed: Sep. 23, 2024

(65) Prior Publication Data

US 2025/0304348 A1 Oct. 2, 2025

(30) Foreign Application Priority Data

Mar. 26, 2024 (CN) ..... 202410348510.1

(51) Int. Cl.
*B65D 75/36* (2006.01)
*B65D 75/56* (2006.01)

(52) U.S. Cl.
CPC ..... *B65D 75/368* (2013.01); *B65D 75/566* (2013.01); *B65D 2215/04* (2013.01); *B65D 2585/88* (2013.01)

(58) Field of Classification Search
CPC ..... B65D 2585/88; B65D 85/58; B65D 83/0088; B65D 2201/04
See application file for complete search history.

(56) References Cited

U.S. PATENT DOCUMENTS

| | | | | |
|---|---|---|---|---|
| 3,995,767 | A * | 12/1976 | Brindley | B65D 83/02 206/704 |
| 6,889,840 | B2 * | 5/2005 | Schein | B65D 83/0454 221/133 |
| 6,938,775 | B2 * | 9/2005 | Gaffney | B65D 83/0454 206/704 |
| 9,783,353 | B2 * | 10/2017 | Kuo | B65D 73/0057 |
| 9,954,208 | B2 * | 4/2018 | Dorr | B65D 79/02 |
| 2022/0185566 | A1 * | 6/2022 | Renschler | B65D 75/367 |
| 2023/0007966 | A1 | 1/2023 | Felber et al. | |

FOREIGN PATENT DOCUMENTS

CN 113614003 A 11/2021

* cited by examiner

*Primary Examiner* — Mollie Impink
(74) *Attorney, Agent, or Firm* — Westbridge IP LLC

(57) ABSTRACT

A child-resistant packaging for button cells adopts a set of closed blister shells to encapsulate batteries and meets child-resistant requirements. A plurality of battery limiting cavities are formed inside the blister shells. Each battery limiting cavity is provided with a battery accommodating cavity and a battery removal cavity, the side part of the battery accommodating cavity is provided with a first supporting protrusion, the width and the height of the battery removal cavity are bigger than those of a battery, the top surface of the battery removal cavity is provided with a second supporting protrusion, and the bottom surface of the second supporting protrusion is in contact with the top surface of the first supporting protrusion; the outer part of the battery limiting cavity is provided with a shearing protrusion corresponding to the battery removal cavity.

10 Claims, 8 Drawing Sheets

CHILD-RESISTANT PACKAGING FOR BUTTON CELL BATTERIES

CROSS-REFERENCE TO RELATED APPLICATIONS

This application claims priority to Chinese Patent Application No. 202410348510.1, filed on Mar. 26, 2024, the content of which is incorporated herein by reference in its entirety.

TECHNICAL FIELD

This present application relates to the art field of packaging, in particular to a child-resistant packaging for button cell batteries, and more particularly for button cell batteries with irregular shapes such as hearing aid batteries, which solves the cutting problems caused by the complicated packaging.

BACKGROUND

Currently, many small electronic devices, including hearing aids and cochlear implants, are powered by button cell batteries, hence, consumers may store some button cells at home for backup. Generally, button cells are stored in specific packaging. Initially, the packaging of the button cell batteries adopts designs which are convenient for consumers to access batteries, but the packaging designs are also easy for children to open, which are not child-resistant, and may cause serious physical damage once batteries are accidently swallowed by children. Therefore, child-resistant packaging of button cells becomes particularly important.

Though some existing button cell packaging designs can satisfy child-resistant requirements, they also have many disadvantages. For example, some manufacturers use a kind of medicine-bottle packaging. It is required to rotate the bottle cap to open when removing batteries. Although the packaging is child-resistant, but batteries are stacked in the bottle, which poses a risk of short-circuit. For another example, as disclosed in Chinese Patent Application Publication No. CN113614003A and U.S. Patent Application Publication No. US20230007966A1, both patents use plastic blisters to encapsulate batteries, which keep the batteries from being stacked. To remove batteries, it is required to cut the blisters with scissors, but the width of the space reserved for cutting batteries inside the enclosed blisters is less than the width of a battery, which is designed to prevent from cutting batteries carelessly. So after cutting the reserved space, the battery cannot be removed directly. A battery can be removed only after cutting a plurality of times together with other auxiliary actions, which brings great inconvenience to consumers.

Even if the width of the reserved space is increased, as shown in FIG. 1, when packing batteries with enclosed blister shells, the blister shells are subjected to dent inwards due to the shearing force and the pressure of scissors during cutting. The blunter the scissors, the more serious the dent occurs. To remove a battery, simply one cutting is not enough, more actions are involved such as cutting a plurality of times or flattening the incision. A plurality of cutting and the flattening of the incision are inconvenient to operate, numerous packaging fragments can be left after cutting a plurality of times and not easy to be cleaned. There is also a risk of cutting batteries. Since the cutting opening is small, the dent at the opening is not easy to flatten, which increases the difficulty of removing the battery.

If the height of the outer cover is increased blindly, it will lead to excessive packaging volume, and the outer cover is prone to thinning during vacuum forming process due to the excessive height protruding outwards, which further increases the degree of dent during cutting, and also leads to the difficulty of removing batteries, and may even pose a risk of damage of the outer cover. On the other hand, when the height of the outer cover increases excessively, the internal space of the set of blister shells becomes excessive big. This can cause batteries to move around without reliable limit, the batteries are easily to be damaged or facing other risks due to collision during transportation, meanwhile, the packaging independence of each battery cannot be ensured. Moreover, the excessive height of the outer cover also requires the scissors to splay at a larger angle during cutting, thus, increases the difficulty to cut.

SUMMARY

In order to overcome the deficiencies of the prior art, the present application aims to provide a child-resistant packaging for button cell batteries, which can meet the child-resistant requirements while also being convenient for consumers to open the packaging to access batteries.

In order to solve above problems, the technical proposal adopted by the present application is as follows.

The present application disclosures a battery child-resistant packaging, comprising a closed set of blister shells, wherein an inner portion of the blister shells are provided with at least one battery limiting cavity, and the battery limiting cavity comprises a battery accommodating cavity and a battery removal cavity that are interconnected; the battery accommodating cavity is distributed with a first limiting protrusions on both sides, and at least one of the first limiting protrusions comprises a first supporting protrusion; the first supporting protrusion is located on a side of the first limiting protrusion close to the battery removal cavity, and there is a gap formed between a top surface of the first supporting protrusion and a top surface of the battery removal cavity to reserve a shear clearance space in a first direction, wherein the first direction is a height direction of the battery; the battery removal cavity protrudes outward from the first supporting protrusion in both a second direction and a third direction to retain the shear clearance space in both directions; the width and the height of the battery removal cavity are respectively greater than those of the battery, wherein the second direction is a width direction of the battery removal cavity and the third direction is a removal direction of the battery; the top surface of the battery removal cavity comprises a second supporting protrusion extending towards a bottom surface; the second supporting protrusion is located on one side of the battery removal cavity closed to the battery accommodating cavity, and a bottom surface of the second supporting protrusion is in contact with the top surface of the first supporting protrusion; a shearing protrusion is provided on the outside of the set of blister shells at a position corresponding to the battery removal cavity; the shearing protrusion protrudes outward beyond the first supporting protrusion in both the second direction and the third direction; when no shearing occurs, the shearing protrusion closes the battery removal cavity.

Compared with the prior art, the beneficial effects of the present disclosure are as follows.

Firstly, this battery child-resistant packaging comprises a set of blister shells, when no shearing occurs, the shearing protrusion can close the battery removal cavity, making it difficult for children to easily remove the battery inside the blister shells, thus meeting the child-resistant requirements.

Secondly, a plurality of battery limiting cavities are formed inside the set of blister shells, first limiting protrusions are distributed on two sides of each battery limiting cavity, which can limit batteries and keep batteries from moving around. When there are a plurality of battery limiting cavities, the batteries in the battery limiting cavities are packaged independently, and when one battery is taken out, the rest batteries are not affected and still meet child-resistant requirements.

Thirdly, when a battery is required to be taken out, first the shearing protrusion is tilted upwards, so that the battery enters the battery accommodating cavity by gravity, and then cut the shearing protrusion along the second direction. Since each shearing protrusion corresponds to each battery removal cavity, and each battery removal cavity is reserved with a shear clearance space in the second direction and the third direction, so that the battery cannot be cut, the battery can be protected, the battery is prevented from being damaged; and the shearing protrusion also has a certain deformation space, so that a consumer can easily apply forces to cut the shearing protrusion, and the battery is kept in the battery accommodating cavity during cutting, so that the battery will be squeezed by the blister shells.

Fourthly, when the force is applied to cut open the shearing protrusion, the shearing protrusion is subjected to pressure, and the first supporting protrusion and the second supporting protrusion form a support at the edge of the battery removal cavity close to the battery accommodating cavity, limiting the deformation of the shearing protrusion and preventing excessive dent from blocking the battery removal cavity. Therefore, after cutting open the shearing protrusion, make the opening of the battery removal cavity tilt downwards, and the battery will easily fall out of the opening of the battery removal cavity under gravity.

Lastly, since scissors used in daily life become blunt after long-term use, which means greater force is required for cutting, therefore the pressure on the shearing protrusion will increase, and there is a risk of excessive dent of the shearing protrusion. Therefore, in this packaging structure, firstly, the first shearing protrusion protrudes outward beyond the first supporting protrusion in both the second and third directions. Therefore, even if the shearing protrusion dents, it mainly occurs at the part protruding outward beyond the first limiting protrusion. Secondly, through the coordinated support of the first supporting protrusion and the second supporting protrusion, the degree of dent of the shearing protrusion can be greatly limited. Thirdly, the battery removal cavity also retains a shear clearance space in the first direction. Therefore, even when the shearing protrusion dents inward under greater pressure, it only dents above the first supporting protrusion. Due to the coordinated support of the first and second supporting protrusions, the dent above the first supporting protrusion is limited and difficult to dent inward beyond the first supporting protrusion. In other words, the dented material will only remain in the shear clearance space in the first direction. Therefore, through the structural design of these three parts, it is possible to prevent the excessive dent of the blister shells without increasing the height of the blister shells too much. Even if a consumer applies a large force to cut, the width and height of the opening of the battery removal cavity can still be maintained greater than the width and height of the battery, without affecting the removal of the battery.

From the above analysis of the five points, it can be seen that this packaging structure adopts a simple and delicate structural design, which does not require an excessive increase in the height of the set of blister shells. It can meet the requirements of child-resistant while also facilitating consumers to remove batteries. When removing the battery, there is no need to cut it a plurality of times, and after cutting, there is no need to use hands or other tools to level the incision. It only needs to cut the shearing protrusion once along the second direction, and then the battery can be easily removed under gravity. The operation is more convenient and quicker, more user-friendly, and more suitable for middle-aged and senior hearing aids wearers.

According to the above-mentioned battery child-resistant packaging, the set of blister shells comprises an outer cover and an inner cover that are interconnected; the shearing protrusion is arranged at the outer portion of the outer cover, and the second supporting protrusion is arranged at the inner portion of the outer cover; the first limiting protrusion is arranged at the inner portion of the inner cover; the battery accommodating cavity comprises a first accommodating cavity arranged at the inner portion of the outer cover and a second accommodating cavity arranged at the inner portion of the inner cover; the battery removal cavity comprises a first removal cavity arranged at the inner portion of the outer cover and a second removal cavity arranged at the inner portion of the inner cover.

According to the above-mentioned battery child-resistant packaging, a recess is provided on the outer portion of the outer cover at a position corresponding to the first limiting protrusion, so as to form a second limiting protrusion at an inner portion of the outer cover, the second limiting protrusion is configured to limit the position of the battery tab; the bottom surface of the second limiting protrusion is in contact with the top surface of the first limiting protrusion, and the second supporting protrusion is arranged at the edge of the second limiting protrusion.

According to the above-mentioned battery child-resistant packaging, a side wall of the first supporting protrusion and a side wall of the second supporting protrusion are both arc-shaped.

According to the above-mentioned battery child-resistant packaging, the outer cover and the inner cover are thermo-welded the set of blister shells.

According to the above-mentioned battery child-resistant packaging, it further comprises a hanging card, and the set of blister shells is fastened onto the hanging card.

According to the above-mentioned battery child-resistant packaging, the blister shells are disc shaped and can rotatably fix relative to the hanging card, and a plurality of battery limiting cavities are distributed in the circumferential direction of the blister shells; when the shearing protrusion rotates to the first edge of the hanging card, the shearing protrusion protrudes outwards beyond the first edge of the hanging card, and the first supporting protrusion does not protrude beyond the first edge of the hanging card.

According to the above-mentioned battery child-resistant packaging, the outer side of the shearing protrusion is planar.

According to the above-mentioned battery child-resistant packaging, there is a central hole being provided on the hanging card, a first compression fastening structure is provided in the center of the outer cover, a second compression fastening structure is provided in the center of the inner cover, and the first compression fastening structure and the second compression fastening structure penetrate through the central hole and are fastened together.

According to the above-mentioned battery child-resistant packaging, a hanging slot is provided on the hanging card.

According to the above-mentioned battery child-resistant packaging, the set of blister shells is made of blister films or sheets, and the thickness of the films or sheets is between 0.1 mm and 1 mm.

The present application will be further described in detail with reference to the accompanying drawings and specific embodiments.

DETAILED DESCRIPTION OF THE EMBODIMENTS

Figure 1:
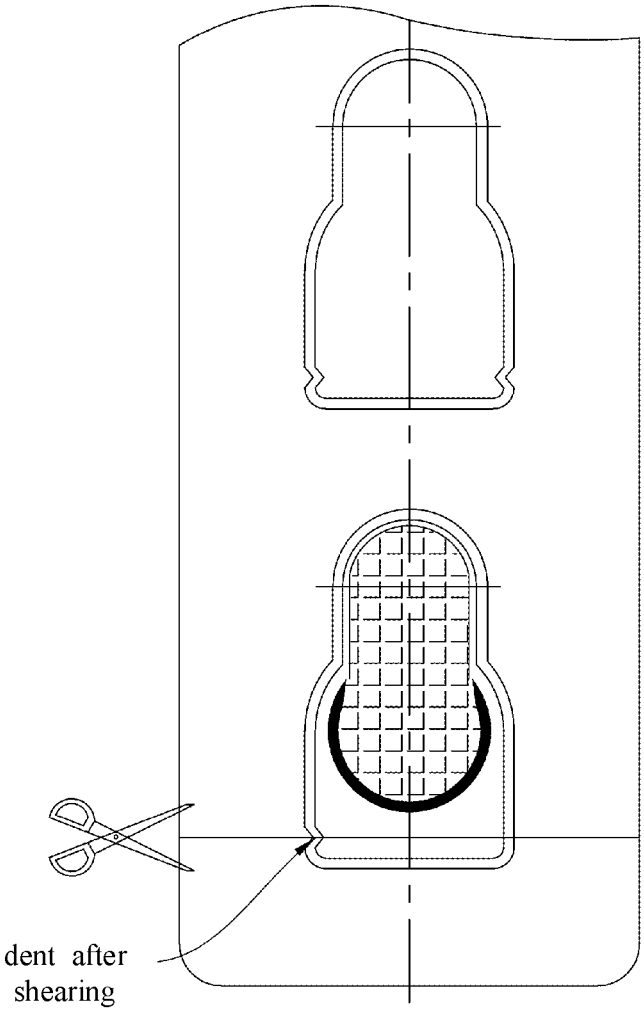
Fig. 1 (Prior Art)
FIG. 1 is a shearing diagram of a battery packaging structure in the prior art.

The following provides a detailed description of the embodiments of the present disclosure, with reference to FIGS. 2-9. The embodiments of the present disclosure provide a child-resistant packaging for button cell batteries, comprising a set of blister shells 100. The battery 300 is encapsulated in the inner portion of the set of blister shells 100 and cannot be easily opened by children, thus meeting child-resistant requirements. One set of blister shells 100 can encapsulate only one battery 300 or a plurality of batteries 300. When a plurality of batteries 300 are encapsulated in one set of blister shells 100, they are packaged independently of each other.

The inner portion of the set of blister shells 100 is provided with at least one battery limiting cavity 110, the battery limiting cavity 110 is configured to place the battery 300 and limit the battery 300 to prevent it from moving around. When the plurality of batteries 300 are packaged in one set of blister shells 100, there are a plurality of battery limiting cavities 110, and the plurality of battery limiting cavities 110 are separated from each other to prevent the batteries 300 from contacting each other.

Figure 3:
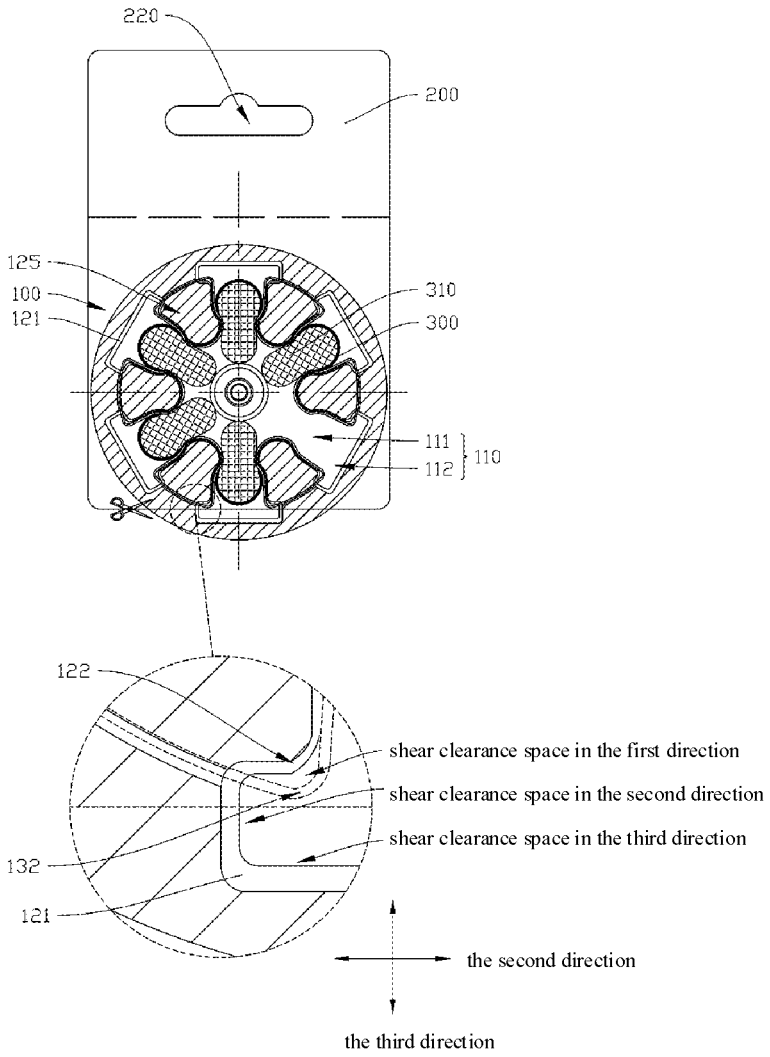
FIG. 3 is a front view of the structure shown in FIG. 2.
Figure 4:
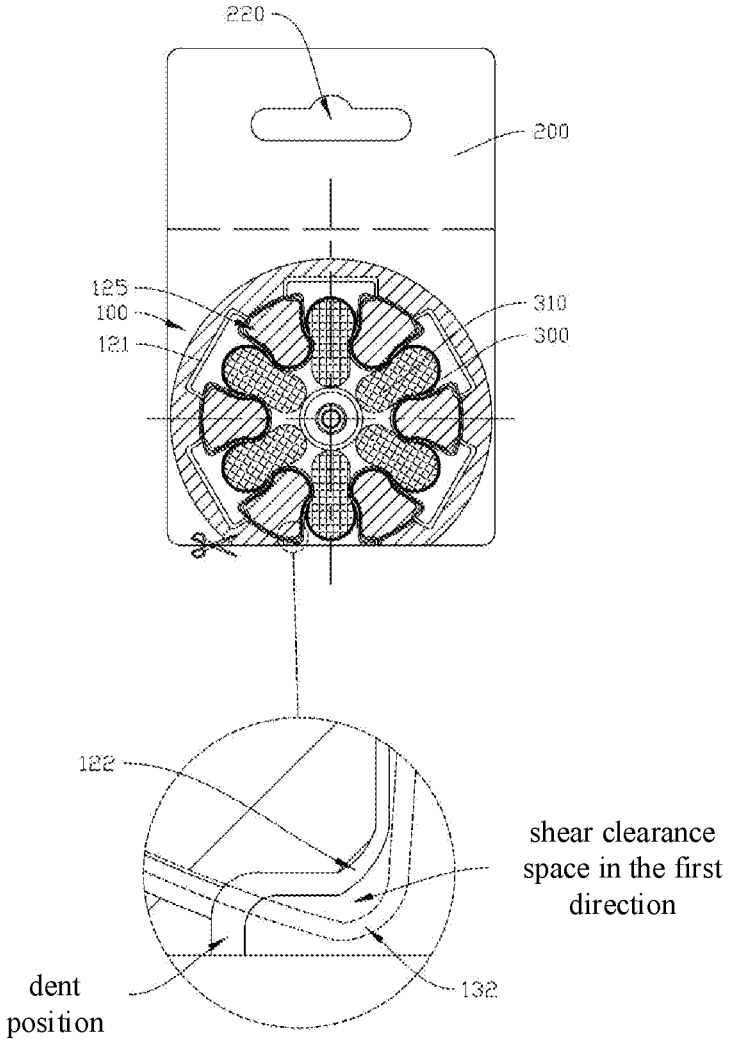
FIG. 4 is a schematic diagram of the structure shown in FIG. 3 after cutting.
Figure 6:
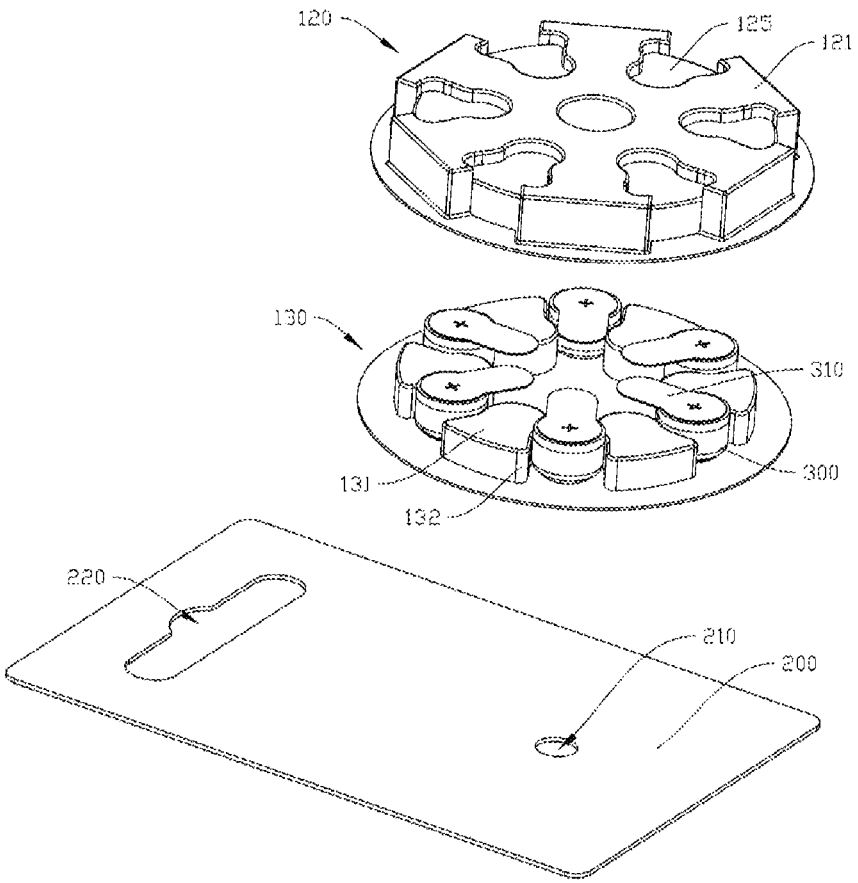
FIG. 6 is a front exploded view of the child-resistant battery packaging according to an embodiment of the present disclosure.

As shown in FIGS. 3, 4, and 7 to 9, the battery limiting cavity 110 comprises a battery accommodating cavity 111 and a battery removal cavity 112 that are interconnected. When the battery 300 is not removed, the battery removal cavity 112 is closed and the battery 300 is placed inside the battery accommodating cavity 111. Of course, the battery 300 can also move slightly between the battery accommodating cavity 111 and the battery removal cavity 112. When it is necessary to cut open the shearing protrusion 121, the battery 300 is stored in the battery accommodating cavity 111. When removing the battery 300, it enters the battery removal cavity 112 from the battery accommodating cavity 111 and falls out from the opening of the battery removal cavity 112. As shown in FIGS. 3, 4, and 6, the first limiting protrusions 131 are distributed on both sides of the battery accommodating cavity 111. When there are a plurality of battery limiting cavities 110, there are also a plurality of first limiting protrusions 131, and battery accommodating cavities 111 are distributed alternatively with first limiting protrusions 131. The first limiting protrusions 131 on both sides of the battery accommodating cavity 111 can limit the battery 300, so that the battery 300 can be kept in the battery limiting cavity 110. At least one first limiting protrusion 131 comprises a first supporting protrusion 132. In this embodiment, the first supporting protrusions 132 are provided on the first limiting protrusions 131 on both sides of the battery accommodating cavity 111, and there is a gap formed between the top surface of the first supporting protrusion 132 and the top surface of the battery removal cavity 112 to reserve shear clearance space in the first direction, wherein the first direction is the height direction of the battery 300. Wherein, in FIG. 3, in order to better show the battery limiting cavity 110, one of the batteries 300 has been hidden.

Figure 7:
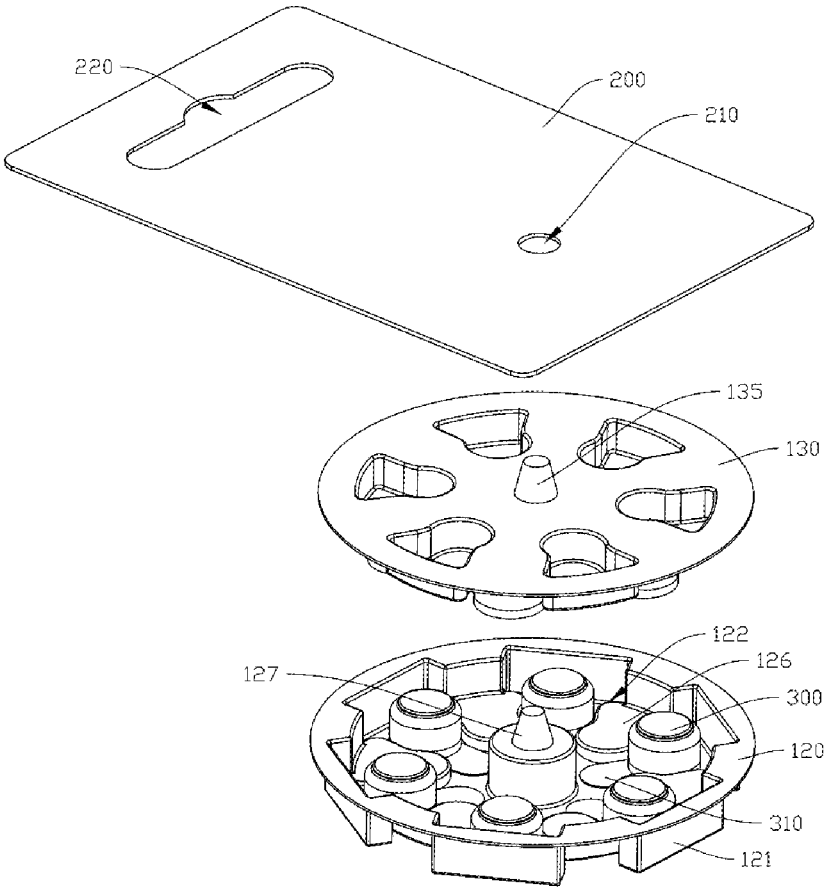
FIG. 7 is a rear exploded view of the child-resistant battery packaging with the structure shown in FIG. 6.
Figure 8:
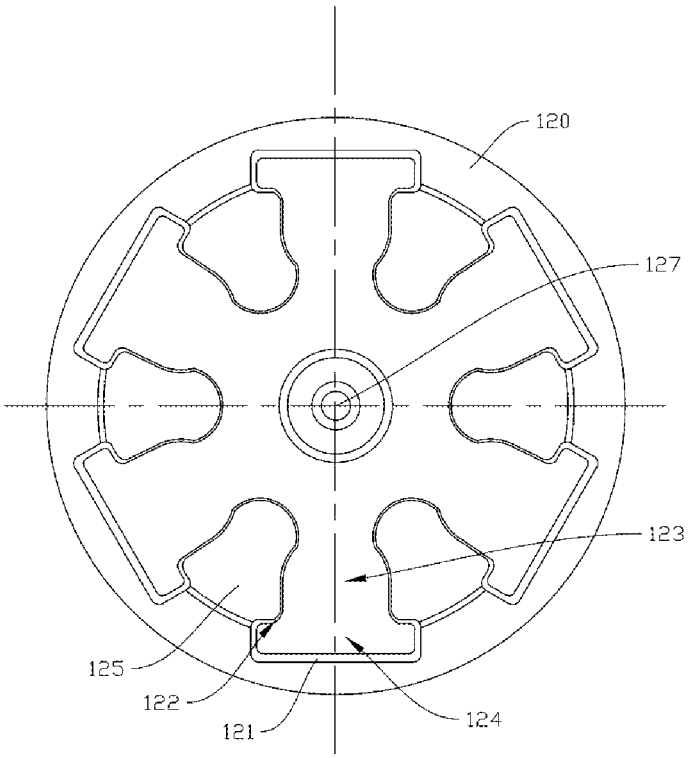
FIG. 8 is a front view of the outer cover of the child-resistant battery packaging according to an embodiment of the present disclosure.
Figure 9:
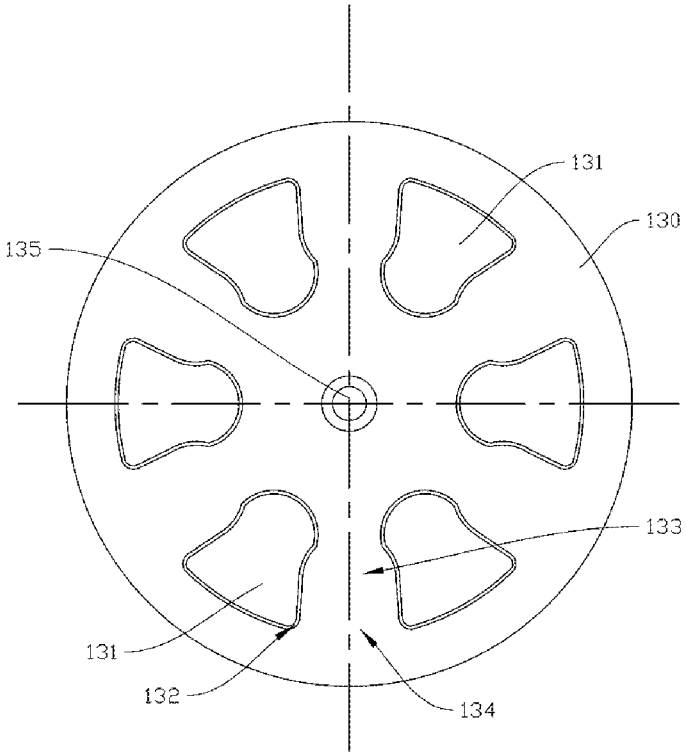
FIG. 9 is a front view of the inner cover of the child-resistant battery packaging according to an embodiment of the present disclosure.

As shown in FIGS. 3, 4, and 8, the battery removal cavity 112 protrudes outward beyond the first supporting protrusion 132 in both the second and third directions to retain the shear clearance space in both the second and third directions. The width and the height of the battery removal cavity 112 are respectively greater than those of the battery 300, amongst the second direction is the width direction of the battery removal cavity 112 and the third direction is the removal direction of the battery 300. As shown in FIG. 7, the top surface of the battery removal cavity 112 comprises a second supporting protrusion 122 protruding towards the bottom surface. The second supporting protrusion 122 is located on one side of the battery removal cavity 112 close to the battery accommodating cavity 111, and the bottom surface of the second supporting protrusion 122 is in contact with the top surface of the first supporting protrusion 132. A shearing protrusion 121 is provided on the outside of the set of blister shells 100 at a position corresponding to the battery removal cavity 112; the shearing protrusion 121 protrudes outward beyond the first supporting protrusion 132 in both the second direction and the third direction; when not sheared, the shearing protrusion 121 closes the battery removal cavity 112. When each first limiting protrusion 131 located at both sides of the battery accommodating cavity 111 is provided with a first supporting protrusions 132, the corresponding positions on both sides of the top surface of the battery removal cavity 112 are also provided with the second supporting protrusions 122, so that both sides of the shearing protrusions 121 along the second direction can be supported by the first supporting protrusions 132 and the second supporting protrusions 122, which is beneficial to both consumers who are left-handed or right-handed.

Compared with the prior art, this battery child-resistant packaging comprises a set of blister shells 100, when not sheared, the shearing protrusion 121 can close the battery removal cavity 112, so that the child cannot easily take out the battery 300 from the blister shells 100, thus meeting the child-resistant requirements. A plurality of battery limiting cavities 110 are formed inside the set of blister shells 100, the first limiting protrusions 131 are distributed on both sides of each battery limiting cavity 110, which can limit the position of batteries 300 and keep batteries 300 from moving around. When there are a plurality of battery limiting cavities 100, the batteries 300 in the battery limiting cavities 110 are packaged independently, and when one battery 300 is removed, the rest batteries 300 are not affected and the child-resistant requirements are still meet.

Figure 2:
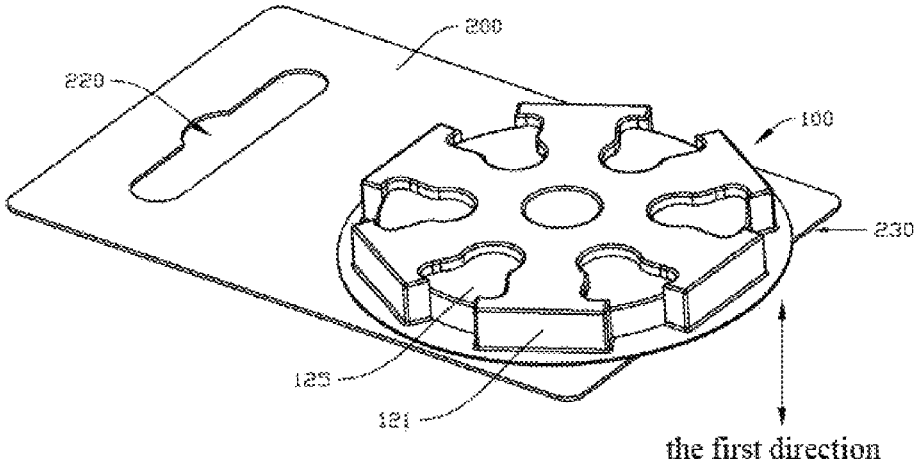
FIG. 2 is a schematic diagram of an overall structure of the child-resistant battery packaging according to an embodiment of the present disclosure.

When a battery 300 is required to be removed, the shearing protrusion 121 is tilted upwards firstly, so that the battery 300 enters the battery accommodating cavity 111 by gravity, and then cut the shearing protrusion 121 along the second direction. Since each shearing protrusion 121 corresponds to each battery removal cavity 112, and each battery removal cavity 112 is reserved with a shear clearance space in the second direction and the third direction, so that the battery 300 cannot be cut, the battery 300 can be protected, the battery 300 is prevented from being damaged; and the shearing protrusion 121 also has a certain deformation space, so that a consumer can easily apply forces to cut the shearing protrusion 121, and the battery 300 is kept in the battery accommodating cavity 111 during cutting, so that the battery 300 will not be squeezed by the blister shells 100. When applying force to cut open the shearing protrusion 121, the shearing protrusion 121 is subjected to pressure. As shown in FIGS. 2 to 4, the first supporting protrusion 132 and the second supporting protrusion 122 form a support at the edge of the battery removal cavity 112 close to the battery accommodating cavity 111, limiting the deformation of the shearing protrusion 121 and preventing excessive dent from blocking the battery removal cavity 112. Therefore, after cutting open the shearing protrusion 121, make the opening of the battery removal cavity 112 tilted, and the battery 300 will easily fall out of the opening of the battery removal cavity 112 under gravity.

Figure 5:
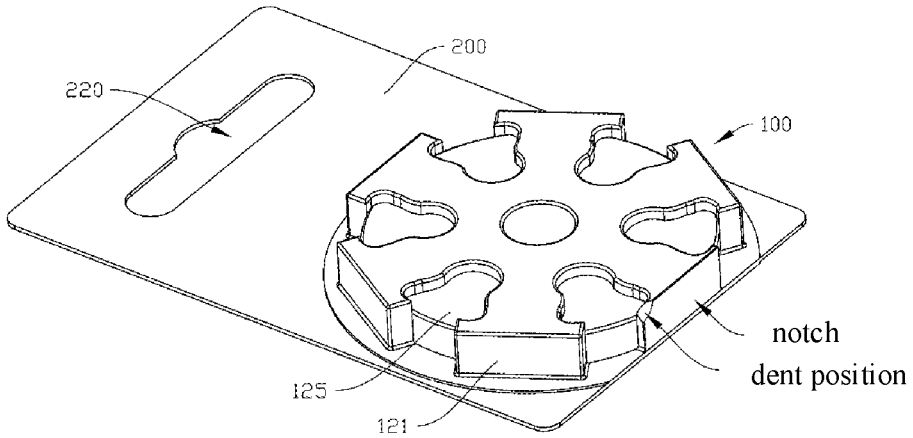
FIG. 5 is a schematic diagram of the structure shown in FIG. 2 after cutting.

Since scissors used in daily life become blunt after long-term use, which means greater force is required for cutting, therefore the pressure on the shearing protrusion 121 will increase, and there is a risk of excessive dent of the shearing protrusion 121. Therefore, in present packaging structure, firstly, the first shearing protrusion 121 protrudes outward beyond the first supporting protrusion 132 in both the second and third directions. Therefore, as shown in FIG. 3, even if the shearing protrusion 121 dents, it mainly occurs at the part protruding outward beyond the first limiting protrusion 131. Secondly, through the coordinated support of the first supporting protrusion 132 and the second supporting protrusion 122, the degree of dent of the shearing protrusion 121 can be greatly limited. Thirdly, the battery removal cavity 112 also retains a shear clearance space in the first direction. Therefore, as shown in FIG. 4, even when the shearing protrusion 121 dents inward under greater pressure, it only dents above the first supporting protrusion 132. Due to the coordinated support of the first supporting protrusion 132 and the second supporting protrusion 122, the dent above the first supporting protrusion 132 is limited and difficult to dent inward beyond the first supporting protrusion 132. In other words, the dented material will only remain in the shear clearance space in the first direction. Therefore, through the structural design of these three parts, it is possible to prevent the excessive dent of the blister shells 100 without increasing the height of the blister shells 100 too much. As shown in FIG. 5, even if a consumer applies a large force to cut, the width and height of the opening of the battery removal cavity 112 can still be maintained greater than the width and height of the battery 300, without affecting the removal of the battery 300.

Therefore, it can be seen that this packaging structure adopts a simple and delicate structural design, which does not require an excessive increase in the height of the set of blister shells 100. It can meet the child-resistant requirements while also facilitating consumers to remove batteries 300. When removing the battery 300, there is no need to cut it a plurality of times, and after cutting, there is no need to use hands or other tools to level the incision. It only needs to cut the shearing protrusion 121 once along the second direction, and then the battery 300 can be easily removed under gravity. The operation is more convenient and quicker, more user-friendly, and more suitable for middle-aged and senior hearing aids wearers.

Furthermore, the set of blister shells 100 is made of blister films or sheets through a blister process. The material of the film or sheet comprises but is not limited to PVC, PC, PET, PU, etc. The thickness of the film or sheet is between 0.1 mm to 1 mm, preferably 0.2 mm to 0.5 mm. Furthermore, as shown in FIGS. 5 to 9, the set of blister shells 100 comprises an outer cover 120 and an inner cover 130 that are interconnected. The outer cover 120 and the inner cover 130 can be thermo-welded and together. The outer cover 120 and the inner cover 130 are thermo-welded together to form an encapsulated set of blister shells 100 of the battery 300. Without tools, the outer cover 120 is not easy to open, thus achieving the child-resistant effect. Furthermore, the first limiting protrusion 131 is located in the inner portion of the inner cover 130, as shown in FIGS. 6 to 8. The shearing protrusion 121 is arranged on the outer portion of the outer cover 120, and the second supporting protrusion 122 is arranged at the inner portion of the outer cover 120. A recess 125 is provided on the outer portion of the outer cover 120 at a position corresponding to the first limiting protrusion 131, so as to form a second limiting protrusion 126 in the inner portion of the outer cover 120. The second limiting protrusion 126 is used to limit the position of the battery tab 310. Therefore, the cooperation of the first limiting protrusion 131 and the second limiting protrusion 126 can prevent the battery 300 and the battery tab 310 from moving around. Preferably, the recess height of the recess 125 is 1.5 mm, and the protrusion distances of the shearing protrusion 121 protruding outwards beyond the first supporting protrusion 132 in both the second and third directions are all 2 mm.

Specifically, the bottom surface of the second limiting protrusion 126 is in contact with the top surface of the first limiting protrusion 131, and the second supporting protrusion 122 is arranged at the edge of the second limiting protrusion 126, so as to realize the mutual support between the first supporting protrusion 132 and the second supporting protrusion 122. When welding the outer cover 120 and the inner cover 130, the bottom surface of the second limiting protrusion 126 can be thermo-welded to the top surface of the first limiting protrusion 131 to ensure their relative position and mutual support. Specifically, the battery accommodating cavity 111 comprises a first accommodating cavity 123 arranged in the inner portion of the outer cover 120 and a second accommodating cavity 133 arranged in the inner portion of the inner cover 130. The battery removal cavity 112 comprises a first removal cavity 124 arranged in the inner portion of the outer cover 120 and a second removal cavity 134 arranged in the inner portion of the inner cover 130. Furthermore, the side walls of the first supporting protrusion 132 and the second supporting protrusion 122 are both arc-shaped, so that the supporting between the first supporting protrusion 132 and the second supporting protrusion 122 can be strengthened. Moreover, since the first supporting protrusion 132 is located at the junction between the battery accommodating cavity 111 and the battery removal cavity 112, the arc-shaped first supporting protrusion 132 can also guide the battery 300 to slide out.

Furthermore, as shown in FIGS. 2 to 7, the child-resistant battery packaging in this embodiment also comprises a hanging card 200, and the set of blister shells 100 is fastened onto the hanging card 200. And information such as a user manual can be printed on the hanging card 200. Specifically, a hanging slot 220 is formed in the hanging card 200 to facilitate hanging, vending and storage. Furthermore, the blister shells 100 is disc shaped and can rotatably fix relative to the hanging card 200. the blister shells 100 in disc shapes is attractive in appearance, and the rotatable structure can also increase the ornamental value of the packaging structure. Specifically, there is a central hole 210 is provided on the hanging card 200, a first compression fastening structure 127 is provided in the middle of the outer cover 120, a second compression fastening structure 135 is provided in the middle of the inner cover 130, and the first compression fastening structure 127 and the second compression fastening structure 135 penetrate through the central hole 210 and are fastened together to achieve the rotatability of the blister shells 100.

Furthermore, there are a plurality of battery limiting cavities 110 distributed in the circumferential direction of the blister shells 100. As shown in FIGS. 2 and 3, when taking out the battery 300, the blister shells 100 can be rotated. When the shearing protrusion 121 rotates to the first edge of the hanging card 200, the shearing protrusion 121 protrudes outward beyond the first edge of the hanging card 200, and the first supporting protrusion 132 does not protrude beyond the first edge of the hanging card 200. At same time, the first edge of the hanging card 200 can be used as a cutting reference line to cut along the first edge of the hanging card 200, so that the first supporting protrusion 132 is not cut, the cutting action is not affected, the first supporting protrusion 132 is prevented from being damaged by cutting, and the hanging card 200 will not be cut. Each time a battery 300 is taken, one shearing protrusion 121 can be rotated to the first edge of the hanging card 200 for cutting. After a plurality of cuttings, the hanging card 200 can still remain intact. After removing a plurality of batteries 300, the hanging card 200 still has its original size, making it less likely to be lost and easier for consumers to find and use. After cutting open one shearing protrusion 121, the other shearing protrusions 121 are not affected, and the battery 300 can still be stored in the battery limiting cavity 110 corresponding to the other shearing protrusions 121, and still has child-resistant function. In order to further improve the convenience of cutting, the outer side of the shearing protrusion 121 is planar. When a battery 300 is taken, rotate the blister shells 100; when the outer side of the shearing protrusion 121 is approximately parallel to the first edge of the hanging card 200, the shearing protrusion 121 can be cut along the first edge of the hanging card 200, which is convenient for operation and does not require a preset cutting reference line on the hanging card 200, simplifying the printing process of the packaging structure of the battery 300.

It should be noted that in the description of the present disclosure, any reference to orientation or positional relationships, such as up, down, front, rear, left, right, etc., is based on the orientation or positional relationships shown in the drawings. This is only for the convenience of describing the present disclosure and simplifying the description, and does not indicate or imply that the device or component referred to must have a specific orientation, be constructed or operated in a specific orientation, and cannot be understood as a limitation of the present disclosure.

In the description of the present disclosure, the meaning of 'some' refers to one or more, 'a plurality of' refers to two or more, 'greater than', 'less than', 'exceeding', etc. are understood as not including this number, and 'above', 'below', 'within', etc. are understood as including this number. If there is a description of 'first' or 'second' etc., it is only used for the purpose of distinguishing technical features, and cannot be understood as indicating or implying relative importance or implying the number of the indicated technical features, or implying the order of the indicated technical features.

In the description of the present disclosure, unless otherwise explicitly limited, terms such as setting, installation, and connection should be broadly understood. Those skilled in the art can reasonably determine the specific meanings of the above terms in the present disclosure based on the specific content of the technical solution.

The above embodiments are only preferred embodiments of the present disclosure and cannot be used to limit the scope of protection of the present disclosure. Any non substantial changes and substitutions made by those skilled in the art on the basis of the present disclosure shall fall within the scope of protection required by the present disclosure.

What claimed is:

1. A child-resistant packaging for button cell batteries, comprising a blister shells, wherein an inner portion of the blister shells is provided with at least one battery limiting cavity, and the at least one battery limiting cavity comprises a battery accommodating cavity and a battery removal cavity that are interconnected;

a plurality of the battery accommodating cavities are distributed alternatively with a plurality of first limiting protrusions, each first limiting protrusion comprises a first supporting protrusion; the first supporting protrusion is located at a position close to the battery removal cavity relative to each first limiting protrusion, and a gap is formed between a top surface of the first supporting protrusion and a top surface of the battery removal cavity to reserve a shear clearance space in a first direction, wherein the first direction is a height direction of the battery;

the battery removal cavity protrudes outward beyond the first supporting protrusion in both a second direction and a third direction to retain the shear clearance space in both directions; wherein the second direction is a width direction of the battery removal cavity and the third direction is a removal direction of the battery;

the battery removal cavity comprises a second supporting protrusion extending towards a bottom surface; the second supporting protrusion is located on one side of the battery removal cavity close to the battery accommodating cavity, and a bottom surface of the second supporting protrusion is in contact with the top surface of the first supporting protrusion;

a shearing protrusion is provided on an outside of the blister shells at a position corresponding to the battery removal cavity; the shearing protrusion protrudes outward beyond the first supporting protrusion in both the second direction and the third direction; when not sheared, the shearing protrusion closes the battery removal cavity.

2. The child-resistant packaging of claim 1, wherein the blister shells comprises an outer cover and an inner cover that are interconnected;

the shearing protrusion is arranged on the outer cover, and at least one second supporting protrusion is arranged the outer cover;

each first limiting protrusion is arranged at the inner cover;

the battery accommodating cavity comprises a first accommodating cavity and a second accommodating cavity;

the battery removal cavity comprises a first removal cavity and a second removal cavity.

3. The child-resistant packaging of claim 2, wherein at least one recess is provided on the outer cover at a position corresponding to each first limiting protrusion, so as to form a second limiting protrusion inside the outer cover, the second limiting protrusion is used to limit a position of the battery tab;

a bottom surface of the second limiting protrusion is in contact with a top surface of each first limiting protrusion, and the second supporting protrusion is arranged at an edge of the second limiting protrusion.

4. The child-resistant packaging of claim 3, wherein side walls of the first supporting protrusion and side walls of the second supporting protrusion are both arc-shaped.

5. The child-resistant packaging of claim 2, wherein the outer cover and the inner cover are thermo-welded to form the blister shells.

6. The child-resistant packaging of claim 2, further comprising: a hanging card, wherein the blister shells is fastened onto the hanging card.

7. The child-resistant packaging of claim 6, wherein the blister shells is disc shaped and is capable of being rotatably fixed relative to the hanging card; a plurality of the battery limiting cavities are distributed in a circumferential direction of the blister shells;

when the shearing protrusion rotates to a first edge of the hanging card, the shearing protrusion protrudes outward beyond the first edge of the hanging card.

8. The child-resistant packaging of claim 7, wherein an outer side of the shearing protrusion is planar.

9. The child-resistant packaging of claim 7, wherein a central hole is provided on the hanging card, a first riveting structure is provided in a middle of the outer cover, a second riveting structure is provided in a middle of the inner cover, and the first riveting structure and the second riveting structure both penetrate through the central hole and are fastened together.

10. The child-resistant packaging of claim 1, wherein the blister shells is made of blister films or sheets, and a thickness of the films or the sheets is between 0.1 mm and 1 mm.

* * * * *